US008657185B2

(12) United States Patent
Corey

(10) Patent No.: US 8,657,185 B2
(45) Date of Patent: Feb. 25, 2014

(54) MOVEABLE MAILBOX TRAY

(76) Inventor: Diane Corey, Knoxville, TN (US)

( * ) Notice: Subject to any disclaimer, the term of this patent is extended or adjusted under 35 U.S.C. 154(b) by 0 days.

(21) Appl. No.: 13/551,875

(22) Filed: Jul. 18, 2012

(65) Prior Publication Data

US 2013/0020384 A1 Jan. 24, 2013

Related U.S. Application Data

(60) Provisional application No. 61/509,620, filed on Jul. 20, 2011.

(51) Int. Cl.
*A47G 29/14* (2006.01)

(52) U.S. Cl.
USPC ..... 232/29; 232/17

(58) Field of Classification Search
USPC ..... 232/17, 27–29, 33, 45; 220/528; 206/557, 514
See application file for complete search history.

(56) References Cited

U.S. PATENT DOCUMENTS 838,194 A * 12/1906 Larsh ..... 232/17
908,543 A * 1/1909 Brown ..... 232/34
2,760,721 A * 8/1956 Roberts ..... 232/33
2,868,444 A * 1/1959 Whittier ..... 232/45
4,600,143 A 7/1986 Harlow, Jr. et al.
4,753,385 A 6/1988 Phipps et al.
4,896,827 A * 1/1990 Economou ..... 232/17
4,932,587 A 6/1990 Robbins
4,934,592 A * 6/1990 DiMenichi ..... 232/17
5,009,366 A 4/1991 van Druff, Jr. et al.
5,271,555 A 12/1993 Mayer
5,425,501 A 6/1995 Wesorick
5,775,578 A 7/1998 Baxi et al.
6,698,651 B1 3/2004 Green
6,997,373 B2 * 2/2006 Flores ..... 232/29
7,004,380 B2 * 2/2006 Gunvaldson ..... 232/29
7,210,616 B1 5/2007 Van Watermulen
8,042,729 B2 * 10/2011 Dinh ..... 232/29
8,388,168 B1 * 3/2013 Li ..... 362/183
2004/0211827 A1 10/2004 Gunvaldson
2005/0258227 A1 11/2005 Flores

* cited by examiner

*Primary Examiner* — William Miller
(74) *Attorney, Agent, or Firm* — Buckingham, Doolittle & Burroughs, LLC

(57) ABSTRACT

A moveable mailbox tray for mounting in a new or existing mailbox wherein said mailbox tray is attached to the door of the mailbox and is repositioned, along with the contents of the mailbox, both horizontally and vertically in the direction of the user when the mailbox door is opened.

9 Claims, 4 Drawing Sheets

MOVEABLE MAILBOX TRAY

CROSS-REFERENCE

This application claims priority from Provisional Patent Application Ser. No. 61/509,620 filed on Jul. 20, 2011.

FIELD OF THE INVENTION

This invention relates to a moveable and tiltable mailbox tray to make it easier for an individual to access the contents of a mailbox.

BACKGROUND

Many people, particularly in rural locations, have mailboxes located along the street on which they live to help facilitate the delivery of the mail by the U.S. Postal Service. However, retrieving the mail from such mailbox locations can be both inconvenient and time consuming if, for example, the resident has to walk down his or her driveway, and perhaps the street, to access the mailbox. The task of retrieving the mail in this manner can be particularly inconvenient and even dangerous during periods of inclement weather. Consequently, many individuals attempt to access such mailboxes from their vehicle.

Nonetheless, accessing a mailbox from a vehicle presents its own set of challenges. For example, it can be difficult to actually retrieve the mail from a mailbox while positioned within a vehicle. More specifically, a driver must first position the vehicle as close to the mailbox as possible so that the driver can extend his or her arm outside of the vehicle and into the mailbox to retrieve the mail. If the driver misjudges the distance between the vehicle and the mailbox, the driver could end up hitting the mailbox with his or her vehicle thereby damaging the mailbox and/or the vehicle. Once the vehicle is properly positioned, the driver must typically unbuckle his or her seat belt, lift themselves upward from the vehicle seat and stretch outside the vehicle window and into the mailbox to retrieve the mail. If the driver chooses to open the vehicle door instead to access the mailbox, the driver risks hitting the vehicle door on the mailbox or mailbox post.

To alleviate some of the forgoing problems associated with retrieving mail from a mailbox while positioned within a vehicle, others have developed mailboxes with moveable trays that can extend outwardly from the mailbox. For example, U.S. Pat. No. 5,271,555 discloses a moveable mailbox tray in the form of a trolley that rides on a plurality of rollers that enables the tray to move in and out of the mailbox. The device disclosed in the '555 patent is further comprised of a first spring for connecting the moveable trolley to a hinged mailbox door and an opposing second spring for connecting the opposite end of the trolley to a fixed wall of the mailbox. However, such device has inherent limitations. For example, the rollers can become clogged with dirt or other debris over time and lose their functionality. In addition, the presence of the first and second springs could be a hazard as the user much reach over at least the first spring when retrieving the mail and could get his or her skin or clothing pinched or caught on the spring. Further, the presence of the second spring, which is in tension when the mailbox is open, could cause the moveable trolley to prematurely retreat into the mailbox, thereby prematurely closing the mailbox door (due to the presence of the first spring) on the user's hand. Finally, the moveable trolley device does not tilt or eject the mail from the device and in the direction of the user.

Consequently, there exists in the art a long-felt need for a moveable and tiltable mailbox tray for receipt of mail and which is automatically repositioned at least partially beyond the interior of the mailbox when the mailbox door is opened. There also exists in the art a long felt need for a moveable mailbox tray that tilts downwardly in the direction of the user to position the contents of the mailbox even closer to the user, thereby adding to the overall convenience of the device. Moreover, there exists in the art a long felt kid for a kit that enables a user to install a moveable and tiltable mailbox tray unto an existing mailbox to spare the user the expense of having to purchase a new mailbox with a moveable, tiltable mailbox tray. Finally, there is a long-felt need for a moveable mailbox tray that accomplishes all of the forgoing objectives and that is relatively inexpensive to manufacture, and safe and easy to use.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one aspect thereof, is a mailbox comprised of a floor, a door with an interior surface, and a moveable mailbox tray, wherein said moveable mailbox tray is comprised of a carrier portion, a rake portion, and a band for attaching said moveable mailbox tray to the interior surface so that when the door is in an open position said moveable mailbox tray is repositioned at least partially outside the mailbox and in a declined position relative to the floor.

The moveable mailbox tray of the present invention enables a user to conveniently and safely retrieve mail from a mailbox from a vehicle without having to exit the vehicle or unsafely extend oneself outside the vehicle window. The moveable and tiltable mailbox tray of the present invention can be incorporated into new mailboxes or can be sold as a kit and easily installed onto an existing mailbox. Finally, the moveable mailbox tray of the present invention is relatively inexpensive to manufacture, and safe and easy to install and use.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

DETAILED DESCRIPTION

Figure 1:
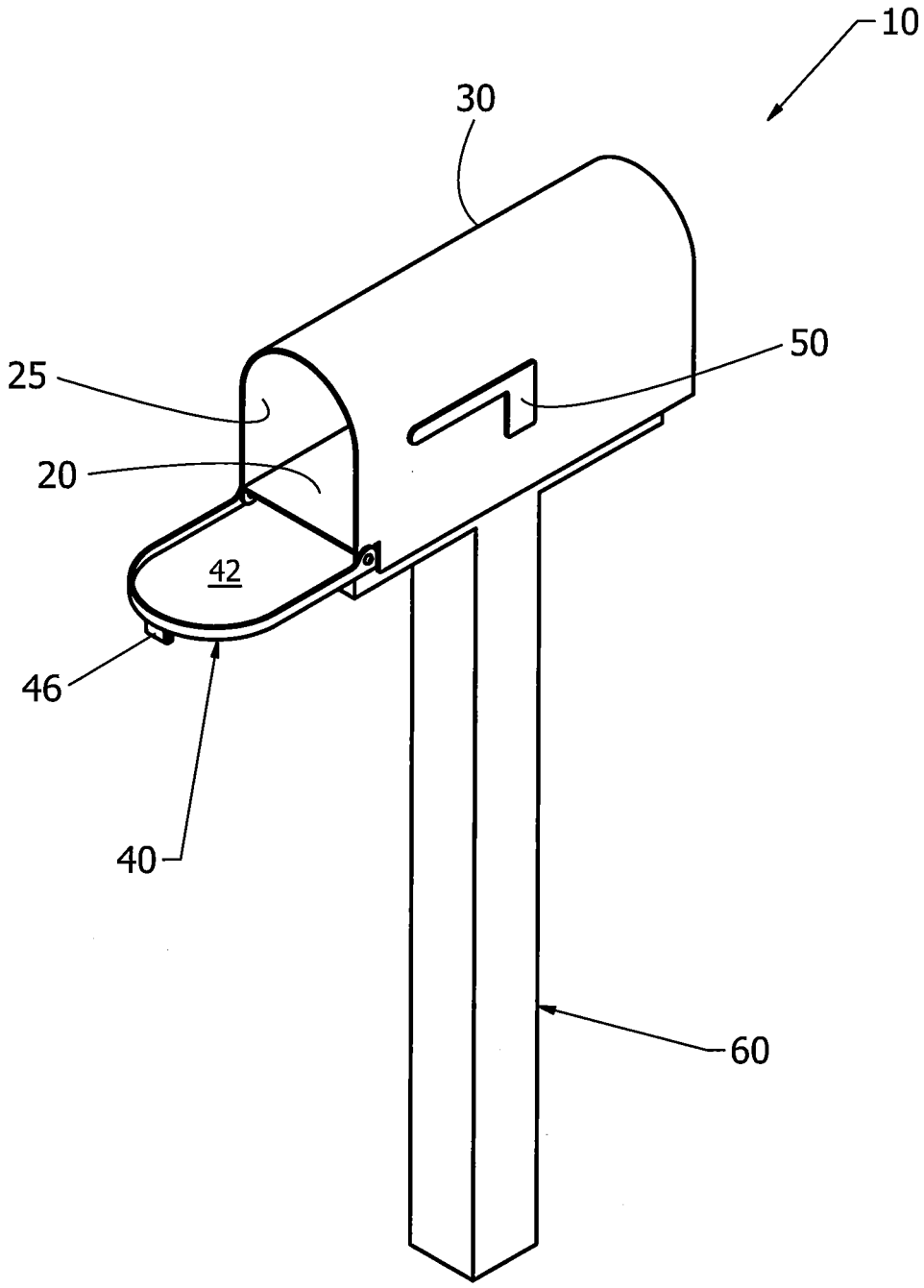
(Prior Art) FIG. 1
FIG. 1 illustrates a perspective view of a prior art mailbox of the type which can be used in conjunction with the present invention.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details.

The mailbox tray of the present invention enables a user to easily and conveniently access the contents of the user's mailbox, for example, from a vehicle without having to exit the vehicle or unsafely extend oneself out of the vehicle's window while the vehicle engine is running. The moveable mailbox tray not only repositions the mail from the interior of the mailbox towards the user, but the tray also tilts the mail in the general direction of the user, thereby making it even easier for the user to retrieve mail from the mailbox. Moreover, the moveable mailbox tray can be offered to the pubic as part a kit to enable users to install the moveable/tiltable mailbox tray onto an existing mailbox. Finally, the sliding mailbox tray of the present invention is relatively inexpensive to manufacture and safe and easy to use.

By way of background and referring initially to the drawings, FIG. 1 illustrates a perspective view of a prior art mailbox 10 of the type which can be used in conjunction with the present invention, though it is contemplated that the present invention could also function with other mailbox styles. Mailbox 10 typically comprises a floor 20, an interior portion 25, a body portion 30 and a door 40 hingedly attached to the floor 20 or body portion 30 for accessing the interior portion 25. The interior portion 25 of mailbox 10 is defined by the floor 20, body portion 30 and door 40, as shown in FIG. 1. Mailbox 10 is typically mounted onto a post 60 or any other suitable structure along a roadside, and may further comprise an indicator device 50 for indicating to the user or a postal worker that mail is present in mailbox 10.

Door 40 may further comprise an interior surface 42, and exterior surface 44 and a handle 46 attached to said exterior surface 44. A user (not shown) accesses the interior portion 25 of mailbox 10 to deposit or retrieve the mail (not shown) by using handle 46 to open door 40 and reaching into mailbox 10. The user may also reposition the indicator device 50 to indicate the presence of mail in mailbox 10. Each of the forgoing features of prior art mailbox 10 are well known in the art in various embodiments and should not be construed as a limitation. However, as previously stated, it can be difficult for a user to access the contents of mailbox 10 from a vehicle due to the distance between the vehicle occupant and the interior of the mailbox 10. An effective solution is necessary.

Figure 2:
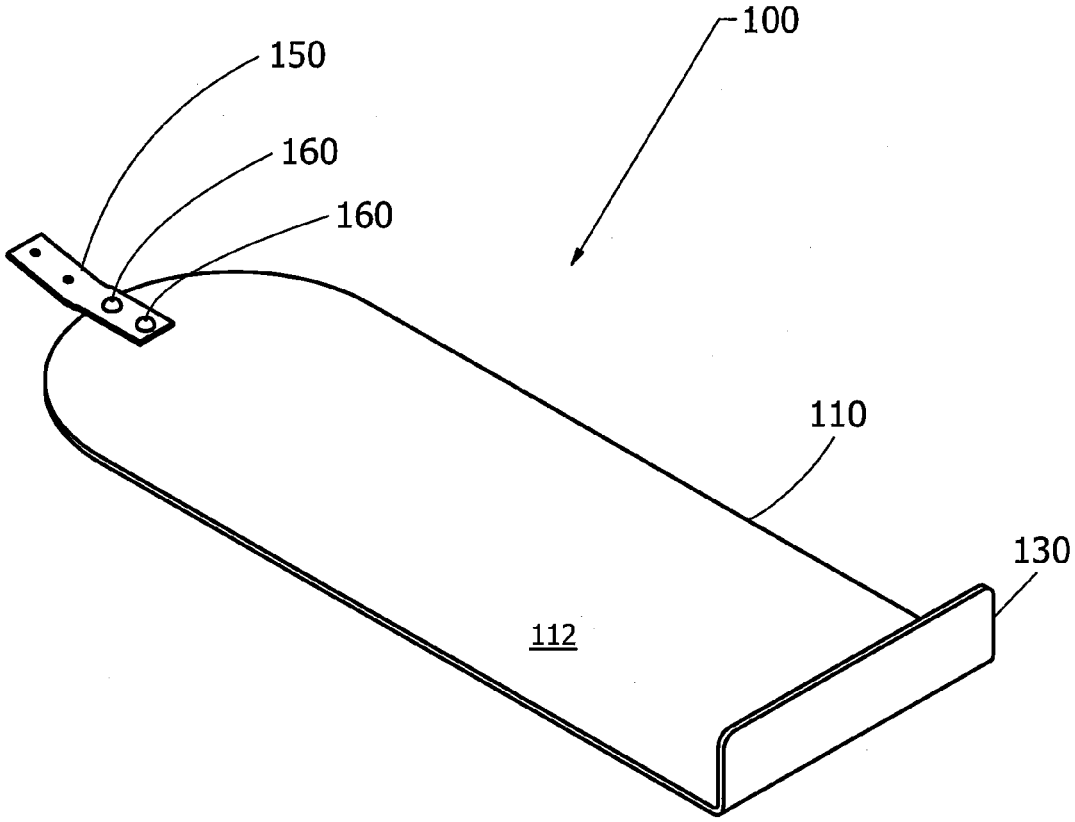
FIG. 2 illustrates a perspective view of the moveable mailbox tray of the present invention.

FIG. 2 illustrates a perspective view of one embodiment of the moveable mailbox tray 100 of the present invention, which comprises a carrier portion 110, a rake portion 130 and a band 150 for attaching mailbox tray 100 to the interior surface 42 of door 40, as described more fully below. Unless otherwise stated herein, the various components of moveable mailbox tray 100 are preferably constructed of a plastic, though it is contemplated that other durable materials, such as wood, metal and the like could also be used without affecting the overall concept of the present invention.

Figure 3A:
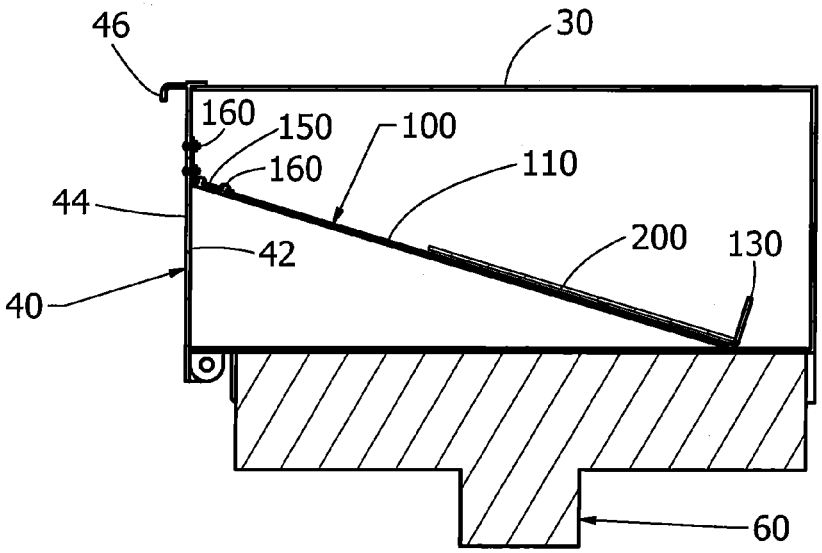
FIG. 3A illustrates a side elevational and cross sectioned view of the moveable mailbox tray of the present invention mounted on the mailbox depicted in FIG. 1 with mail placed thereon and in a closed position.
Figure 3B:
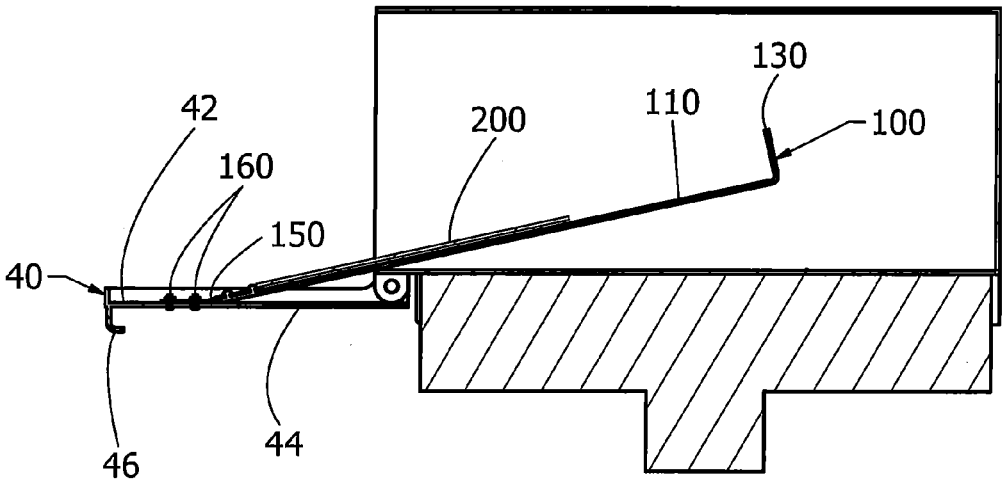
FIG. 3B illustrates a side elevational and cross sectioned view of the moveable mailbox tray of the present invention mounted on the mailbox depicted in FIG. 3A in an opened position.

Carrier portion 110 is a generally flat, plate-like structure that is preferably between 12 and 24 inches in length, and 4 and 8 inches in width though other shapes and sizes are also contemplated provided that carrier portion fits within the interior portion 25 of mailbox 10 and is capable of functioning as described below. Carrier portion 110 further comprises a top surface 112 upon which mail 200 may be placed, as is shown in FIGS. 3A and 3B. At least one end of carrier portion 110 may include a radius or other shape to accommodate the shape of body portion 30 as is shown in the FIGS., and described more fully below.

Rake portion 130 may be integrally formed with carrier portion 110 and preferably rises upward from the top surface 112 of carrier portion 110, as is shown in the FIGS. Nonetheless, it is also contemplated that rake portion 130 can be formed independent of carrier portion 110 and subsequently attached thereto by any suitable means commonly known in the art, such as gluing, welding, fasteners, etc. Rake portion 130 is preferably the same width as carrier portion 110 and between one and four inches in height as measured from top surface 112 of carrier portion 110. The purpose of rake portion 130 is explained more fully below.

Figure 4:
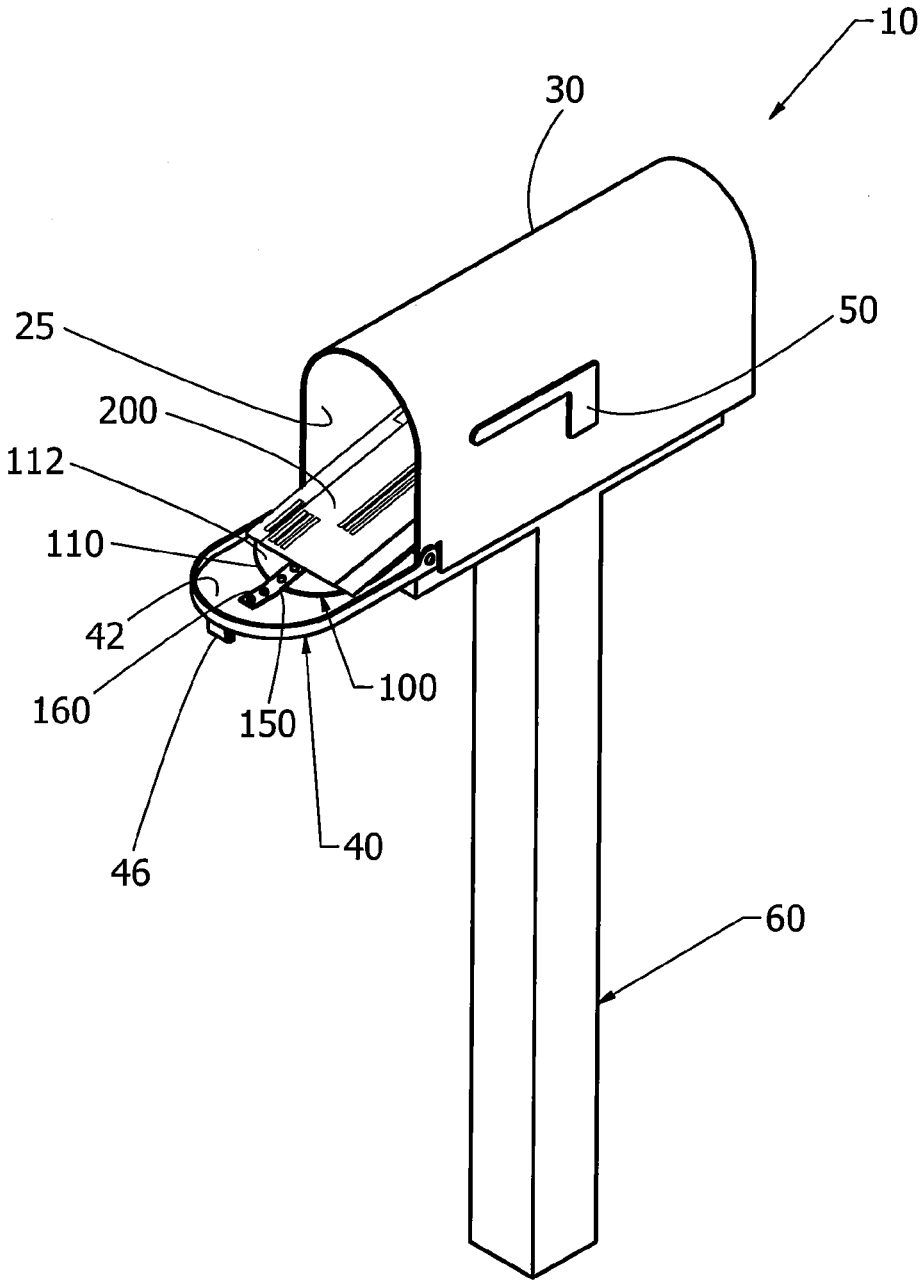
FIG. 4 illustrates a perspective view of moveable mailbox tray of the present invention mounted on the mailbox depicted in FIG. 1 with mail placed thereon.

Band 150 is preferably a relatively flat elongated member comprised of elastic or other relatively flexible material, such as plastic, nylon, mylar, metal or the like. Band 150 may also be formed of a double sided tape, such as Dupont Kapton film, which is durable in extreme temperatures. Band 150 is used to connect mailbox tray 100 to the interior surface 42 of door 40, as best shown in FIG. 4. More specifically, one end of band 150 can be attached to the bottom surface or top surface 112 of carrier portion 110, and the opposite end of band 50 is attached to the interior surface 42 of door 40. The aforesaid attachments can be made by the use of fasteners 160, such as rivets, screws, nails, nuts/bolts, slide clips, hook and loop fasteners or the like, of by any other means commonly known in the art such as tape, adhesive, etc. For example, band 150 may include openings that can be used in connection with the existing screws that are used to attach handle 46 to door 40 on prior art mailbox 10. In an alternative embodiment, band 150 may be formed of a double sided tape with adhesive thereon for easy attachment to interior surface 46 of door 40 on one end, and mailbox tray 100 on the other end.

As explained more fully below, in a preferred embodiment of the present invention, band 150 is attached to interior surface 42 of door 40 so that when door 40 is in the closed position, as depicted in FIG. 3A, mailbox tray 100 is in an inclined position relative to the floor 20 of mailbox 10 with rake portion 130 being on the lower end of mailbox tray 100. The incline of mailbox tray 100 relative to the floor 20 is preferably between 10 and 30 degrees, though other degrees of incline are also contemplated. Similarly, when door 40 is in the open position, as depicted in FIG. 3B, mailbox tray 100 is in a declined position relative to the floor 20 of mailbox 10 with rake portion 130 being on the higher end of mailbox tray 100, which is largely due to the fact that door 40 is positioned below the floor 20 of mailbox 10. Stated differently, the edge of floor 20 nearest door 40 acts as a fulcrum or pivot to mailbox tray 100. The decline of mailbox tray 100 relative to the floor 20 is preferably between 130 and 170 degrees, though other degrees of decline are also contemplated.

Having now described the preferred embodiment of moveable mailbox tray 100, its use and usefulness will now be described. A user such as a postal worker (not shown) desiring to place mail or other articles in mailbox 10 will typically open door 40 using handle 46. As door 40 is opened, mailbox tray 100 will be pulled in the direction of the door by virtue of its connection to interior surface 42 of door 40, and the section of the carrier portion 110 nearest rake portion 130 will slide along the floor 20 of mailbox 10. When mailbox 10 is in the open position, as shown in FIG. 3B, mail 200 can be deposited on the top surface 112 of mailbox tray 100. For this reason, carrier portion 110 should be sized to accommodate as much mail 200 as possible without unduly interfering with body portion 30 mailbox 10.

Once the mail 200 is deposited unto mailbox tray 100, door 40 may be closed which will in turn cause mailbox tray 100 to be pushed into the interior portion 25 of mailbox 10, and the section of the carrier portion 110 nearest rake portion 130 will slide along the floor 20 of mailbox 10 in the direction opposite door 40. As door 40 is closed, the incline of mailbox tray 100 relative to floor 20 will increase. However, rake portion 130 will prevent mail 200 from sliding off of the rear portion of mailbox tray 100. Stated differently, as door 40 is closed, mail 200 will tend to slide along the top surface 112 of carrier portion 110 towards the rear of mailbox 10 until it comes into contact with rake portion 130.

When a user (not shown) opens door 40 to retrieve mail 200, the door 40 will again cause mailbox tray 100 to be pulled in the direction of door 40, along with the mail 200 located thereon by virtue of rake portion 130 which pulls the mail towards the door. As an important aspect of the present invention, when the mailbox 10 is in the fully open position, as shown in FIG. 3B, mailbox tray 100 will be in a declined position relative to the floor 20 of mailbox 10 thereby causing the mail to slide towards the user along the top surface 112 of carrier portion 110.

Additionally, other variations are within the spirit of the present invention. Thus, while the invention is susceptible to various modifications and alternative constructions, a certain illustrated embodiment thereof is shown in the drawings and has been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein. Variations of those preferred embodiments may become apparent to those of ordinary skill in the art upon reading the foregoing description. The inventor expects skilled artisans to employ such variations as appropriate, and the inventor intends for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A mailbox tray for use with a mailbox having an interior width comprising:

a carrier portion, wherein said carrier portion has a width that is substantially the same as the interior width of the mailbox;

a rake portion;

a band comprised of a first end and a second end, wherein said first end is attached to a front portion of said carrier portion and said second end is attached to an interior surface of a mailbox door; and wherein said mailbox further comprises a floor and, when said mailbox door is in an open position said mailbox tray is repositioned in a declined position relative to said floor and, when said door is in a closed position, said mailbox tray is in an inclined position relative to the floor wherein the inclined position of a rear portion of the mailbox tray relative to the floor is between 10 and 30 degrees.

2. The mailbox tray of claim 1 wherein when said mailbox door is in the open position said mailbox tray is repositioned at least partially outside of said mailbox.

3. The mailbox tray of claim 1, wherein the declined position of the mailbox tray relative to the floor is between 130 and 170 degrees.

4. The mailbox tray of claim 1 wherein the band is comprised of a flexible material.

5. A mailbox for receiving mail comprised of:

a floor having a width;

a door with an interior surface;

a moveable mailbox tray, wherein said moveable mailbox tray has a width that is substantially the same as the floor width; and a band for attaching a front portion of said moveable mailbox tray to the interior surface so that when the door is in an open position said moveable mailbox tray is repositioned at least partially outside of said mailbox in a declined position relative to said floor, and wherein when said door is in a closed position, said moveable mailbox tray is in an inclined position relative to the floor wherein the inclined position of a rear portion of the moveable mailbox tray is between 10 and 30 degrees relative to the floor.

6. The mailbox of claim 5 wherein the declined position of the moveable mailbox tray is between 130 and 170 degrees relative to the floor.

7. The mailbox of claim 5 wherein said moveable mailbox tray is further comprised of a carrier portion and a rake portion.

8. The mailbox of claim 7 wherein said carrier portion and said rake portion are integrally formed.

9. The mailbox of claim 5 wherein the band is comprised of a flexible material.

* * * * *